US009291943B2

(12) United States Patent
Yoshizumi

(10) Patent No.: US 9,291,943 B2
(45) Date of Patent: Mar. 22, 2016

(54) IMAGE FORMING APPARATUS AND IMAGE FORMING SYSTEM WITH CARTRIDGE CAPACITY DEPENDENT TRANSPORT FORCE

(71) Applicant: Brother Kogyo Kabushiki Kaisha, Nagoya-shi, Aichi-ken (JP)

(72) Inventor: Hikaru Yoshizumi, Handa (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 14/541,969

(22) Filed: Nov. 14, 2014

(65) Prior Publication Data

US 2015/0139669 A1 May 21, 2015

(30) Foreign Application Priority Data

Nov. 15, 2013 (JP) ..... 2013-236687

(51) Int. Cl.
*G03G 21/18* (2006.01)
*G03G 15/08* (2006.01)
*G03G 21/16* (2006.01)

(52) U.S. Cl.
CPC ..... *G03G 15/0887* (2013.01); *G03G 15/0863* (2013.01); *G03G 15/0806* (2013.01); *G03G 21/1676* (2013.01); *G03G 21/1889* (2013.01)

(58) Field of Classification Search
CPC ..... G03G 21/1889; G03G 21/1892
USPC ..... 399/12
See application file for complete search history.

(56) References Cited

U.S. PATENT DOCUMENTS

| | | | | |
|---|---|---|---|---|
| 7,215,904 | B2 * | 5/2007 | Hasegawa et al. | 399/111 |
| 7,792,440 | B2 * | 9/2010 | Takano et al. | 399/45 |
| 8,306,445 | B2 * | 11/2012 | Suzuki et al. | 399/64 |
| 2010/0202798 | A1 | 8/2010 | Suzuki et al. | |

FOREIGN PATENT DOCUMENTS

| | | | |
|---|---|---|---|
| JP | 2007-108506 | A | 4/2007 |
| JP | 2010-186071 | A | 8/2010 |
| JP | 2011-186880 | A | 9/2011 |
| JP | 2013050489 | A * | 3/2013 |

* cited by examiner

*Primary Examiner* — Clayton E Laballe
*Assistant Examiner* — Leon W Rhodes, Jr.
(74) *Attorney, Agent, or Firm* — Banner & Witcoff, Ltd.

(57) ABSTRACT

An image forming apparatus includes: a cartridge installing section in which a first cartridge and a second cartridge are selectively installable; and a controller. The first cartridge includes: a first case configured to contain a first developer; a first developing roller; and a first transport member configured to transport the first developer toward the first developing roller. The second cartridge includes: a second case configured to contain a second developer, an amount of the second developer being greater than an amount of the first developer; a second developing roller; and a second transport member configured to transport the second developer toward the second developing roller. The controller is configured to control a drive source to drive one of the first transport member and the second transport member.

10 Claims, 8 Drawing Sheets

IMAGE FORMING APPARATUS AND IMAGE FORMING SYSTEM WITH CARTRIDGE CAPACITY DEPENDENT TRANSPORT FORCE

CROSS REFERENCE TO RELATED APPLICATION

The present application claims priority from Japanese Patent Application No. 2013-236687, filed on Nov. 15, 2013, the disclosure of which is incorporated herein by reference in its entirety.

BACKGROUND

1. Field of the Invention

The present invention relates to an image forming apparatus and an image forming system to which one of a first cartridge containing a developer, and a second cartridge containing the developer more than the first cartridge is selectively installable.

2. Description of the Related Art

Conventionally, there is known an image forming apparatus configured such that one of two types of cartridges, which contain different amounts of a developer when the cartridges are unused, is selectively installable. In particular, one of a small capacity cartridge and a large capacity cartridge containing the developer more than the small capacity cartridge is selectively installable (see Japanese Patent Application Laid-open No. 2011-186880, for example). Further, in such an image forming apparatus, each of the cartridges includes a casing containing the developer, a developing roller supported by the casing, an agitator configured to transport the developer in the casing toward the developing roller, and a supply roller configured to supply the developing roller with the developer transported by the agitator.

SUMMARY

However, because the large capacity cartridge contains large amount of the developer, it is usable for a longer period of time than the small capacity cartridge. Therefore, in the large capacity cartridge, it is feared that the developer leaks because, for example, the developing roller is scraped away by the developer present on a seal member.

Accordingly, it is an object of the present teaching to provide an image forming apparatus and an image forming system which are capable of restraining leakage of the developer from the large capacity cartridge.

According to a first aspect of the present teaching, there is provided an image forming apparatus including: a cartridge installing section in which a first cartridge and a second cartridge are selectively installable, the first cartridge including: a first case configured to contain a first developer; a first developing roller; and a first transport member configured to transport the first developer toward the first developing roller, and the second cartridge including: a second case configured to contain a second developer, an amount of the second developer being greater than an amount of the first developer; a second developing roller; and a second transport member configured to transport the second developer toward the second developing roller; and a controller configured to: determine whether the first cartridge is installed in the cartridge installing section or the second cartridge is installed in the cartridge installing section; control a drive source to drive the first transport member to transport the first developer by first transport force, in a case that the controller determines that the first cartridge is installed in the cartridge installing section; and control the drive source to drive the second transport member to transport the second developer by second transport force which is smaller than the first transport force, in a case that the controller determines that the second cartridge is installed in the cartridge installing section.

According to the image forming apparatus having such a configuration as described above, an amount of the second developer transported by the second transport member toward the second developing roller is smaller than an amount of the first developer transported by the first transport member toward the first developing roller. By virtue of this, in the second cartridge usable for a longer period of time than the first cartridge, even if the second developing roller is scraped away by the second developer, for example, it is still possible to restrain leakage of the second developer.

According to a second aspect of the present teaching, there is provided an image forming system including: a first cartridge including: a first case configured to contain a first developer; a first developing roller; and a first transport member configured to transport the first developer in the first case toward the first developing roller by first transport force; a second cartridge including: a second case configured to contain a second developer, an amount of the second developer being greater than an amount of the first developer in the first case; a second developing roller; and a second transport member configured to transport the second developer in the second case toward the second developing roller by second transport force which is smaller than the first transport force; and an image forming apparatus including a cartridge installing section in which the first cartridge and the second cartridge are selectively installable.

According to an image forming system having such a configuration as described above, an amount of the second developer transported by the second transport member toward the second developing roller is smaller than an amount of the first developer transported by the first transport member toward the first developing roller. By virtue of this, in the second cartridge usable for a longer period of time than the first cartridge, even if the second developing roller is scraped away by the second developer, for example, it is still possible to restrain leakage of the second developer.

DESCRIPTION OF THE EMBODIMENTS

[First Embodiment]

Hereinbelow, a first embodiment of the present teaching will be explained in detail while referring to the accompanying drawings as appropriate. In the following description, first, a brief explanation will be made on an overall configuration of a laser printer 1 as an example of an image forming apparatus included in an image forming system. Next, an explanation will be made on details of the characteristic parts of the present teaching.

Further, the following explanation will be made with such directions as based on a user using the laser printer 1. That is, in FIG. 1, the right side is referred to as "front side", the left side is referred to as "rear side", the far side in a direction perpendicular to the page is referred to as "right side", and the near side in the direction perpendicular to the page is referred to as "left side". Further, the up-down direction of the figure is referred to as "up-down direction".

Figure 1:
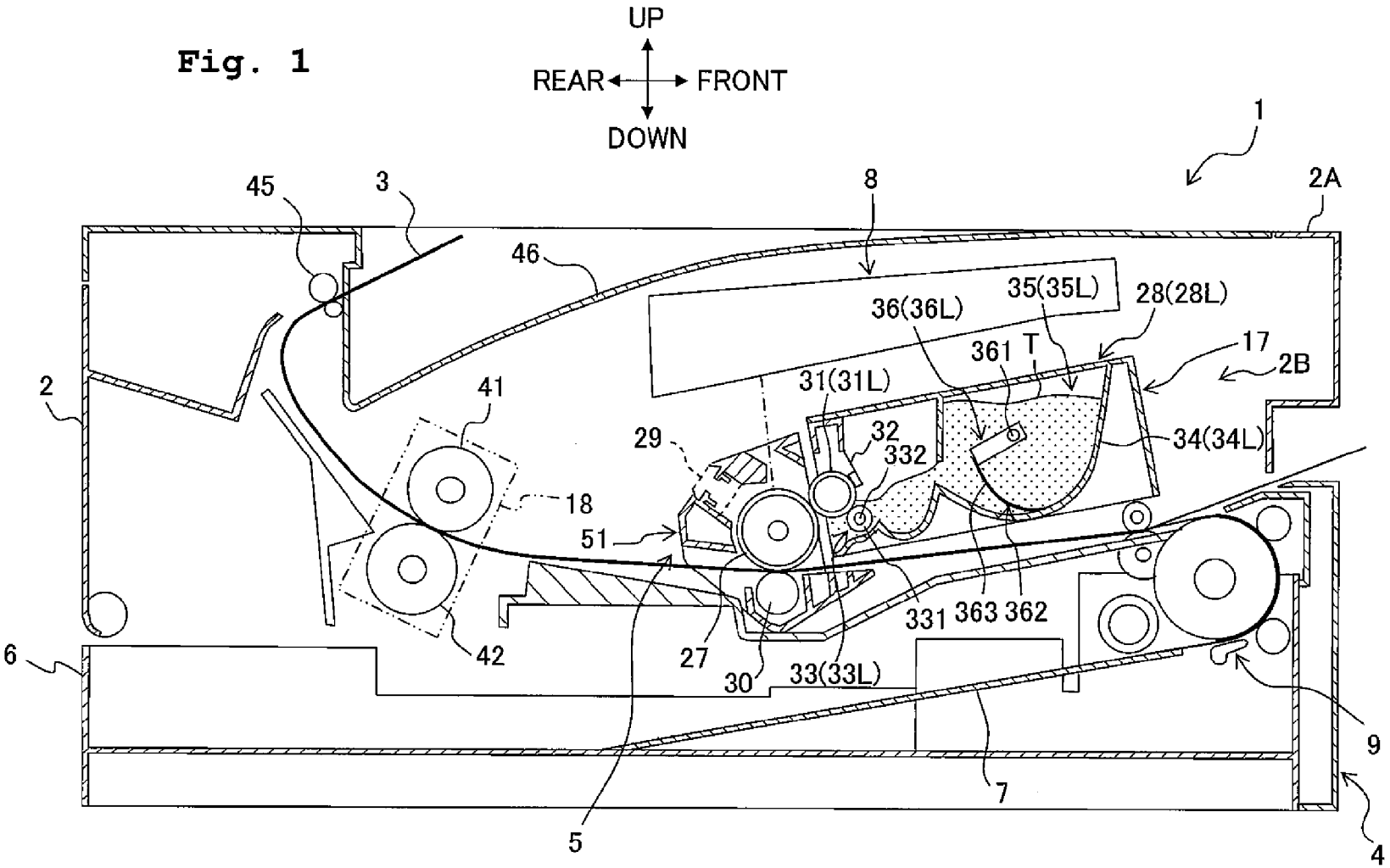
FIG. 1 shows a laser printer in which a small capacity cartridge is installed, according to a first embodiment of the present teaching.

As shown in FIG. 1, the laser printer 1 is provided with a feeder section 4 for feeding sheet 3 into an apparatus main body 2, an image forming section 5 for forming an image on the sheet 3, etc.

The feeder section 4 has a publicly known configuration and is primarily provided with a feed tray 6, a sheet pressing plate 7, and a sheet transporting mechanism 9. Then, in the feeder section 4, the sheet 3 in the feed tray 6 is introduced by the sheet pressing plate 7 to the sheet transporting mechanism 9 arranged above the sheet pressing plate 7, and then transported by the sheet transporting mechanism 9 to the image forming section 5.

The image forming section 5 is provided with a scanner unit 8, a process cartridge 17, a fixing section 18, etc.

The scanner unit 8 is provided with a laser light emitting section, a polygonal mirror, a lens, a reflecting mirror, etc., all of which are not shown. From the scanner unit 8, a laser beam passes through the path indicated by a chain line in each drawing so as to irradiate the surface of a photosensitive drum 27 by way of rapid scanning.

The process cartridge 17 is installable in a cartridge installing section 2B provided in the apparatus main body 2 by appropriately opening a front cover 2A of the apparatus main body 2 on the near side. The process cartridge 17 is constructed primarily of a developing cartridge 28 and a drum unit 51.

The developing cartridge 28 is installed to be either fittable into and removable from the cartridge installing section 2B of the apparatus main body 2 via the drum unit 51 or fittable to and removable from the drum unit 51 fixed on the apparatus main body 2. The developing cartridge 28 is primarily provided with a developing roller 31, a layer thickness restriction blade 32, a supply roller 33, and a case 34 adapted to contain a positively charged toner T as an example of developer.

The case 34 has a toner container 35 adapted to internally contain the toner T, and supports the developing roller 31, the layer thickness restriction blade 32 and the supply roller 33 at the rear side of the toner container 35. Further, an agitator 36 is provided in the toner container 35.

The agitator 36 has a shaft portion 361 rotatably supported by the case 34, and an agitating blade 362 fixed on the shaft portion 361 to be rotatable integrally with the shaft portion 361. The agitator 36 is configured such that the agitating blade 362 rotates inside the toner container 35 while sliding along the inner surface of the toner container 35, along with clockwise rotation of the shaft portion 361 according to FIG. 1. On this occasion, because the toner T inside the toner container 35 is transported by a transport surface 363 oriented to the downstream side in the rotation direction of the agitating blade 362, the toner T inside the toner container 35 is agitated by the agitator 36 while being supplied to the supply roller 33 arranged at the rear side thereof.

The developing roller 31 is capable of holding the toner T on its surface. The layer thickness restriction blade 32 is such a member whose leading end is provided to contact with the surface of the developing roller 31 as to restrict the thickness of the toner T on the developing roller 31.

The supply roller 33 is a member capable of transporting, toward the developing roller 31, the toner T in the case 34 supplied by the agitator 36. The supply roller 33 is arranged in a position obliquely below the developing roller 31 to face the developing roller 31, and provided to be rotatable while in contact with the developing roller 31.

The supply roller 33 has a cylindrical supply roller body 331 extending in an axial direction of the developing roller 31, that is, in a left-right direction, and a supply roller shaft portion 332 inserted into the supply roller body 331 to be rotatable integrally with the supply roller body 331. Further, the supply roller body 331 is formed of, for example, a urethane sponge or the like. Further, the supply roller shaft portion 332 is formed of a metal.

In the developing cartridge 28, the toner T contained in the toner container 35 is first agitated by the agitator 36 and then fed to the developing roller 31 by the supply roller 33, where the toner T is positively charged through friction between the supply roller 33 and the developing roller 31. Along with the rotation of the developing roller 31, the toner T fed onto the developing roller 31 comes between the layer thickness restriction blade 32 and the developing roller 31, and is held on the developing roller 31 as a thin layer of a certain thickness while being further charged through friction.

The drum unit 51 is primarily provided with the photosensitive drum 27 which is publicly known, a scorotron charger 29, and a transfer roller 30. Thereby, inside the drum unit 51, the surface of the photosensitive drum 27 is uniformly charged positively by the scorotron charger 29, and thereafter exposed by way of the rapid scanning of the laser beam from the scanner unit 8. By virtue of this, the potential of the exposed portion decreases, thereby forming an electrostatic latent image based on some image data.

Next, due to the rotation of the developing roller 31, the toner T held on the developing roller 31 is supplied to the electrostatic latent image formed on the surface of the photosensitive drum 27, so as to form a toner image on the surface of the photosensitive drum 27. Thereafter, the sheet 3 is transported therethrough between the photosensitive drum 27 and the transfer roller 30 whereby the toner image carried by the surface of the photosensitive drum 27 is transferred to the sheet 3.

The fixing section 18 has a publicly known configuration, and includes a heating roller 41 and a pressing roller 42. Thereby, in the fixing section 18, the toner T transferred onto the sheet 3 is fixed by heat while the sheet 3 is passing between the heating roller 41 and the pressing roller 42. Further, the sheet 3 finished with the heat fixing by the fixing section 18 is sent out by a discharge roller 45 onto a discharge tray 46.

Figure 2:
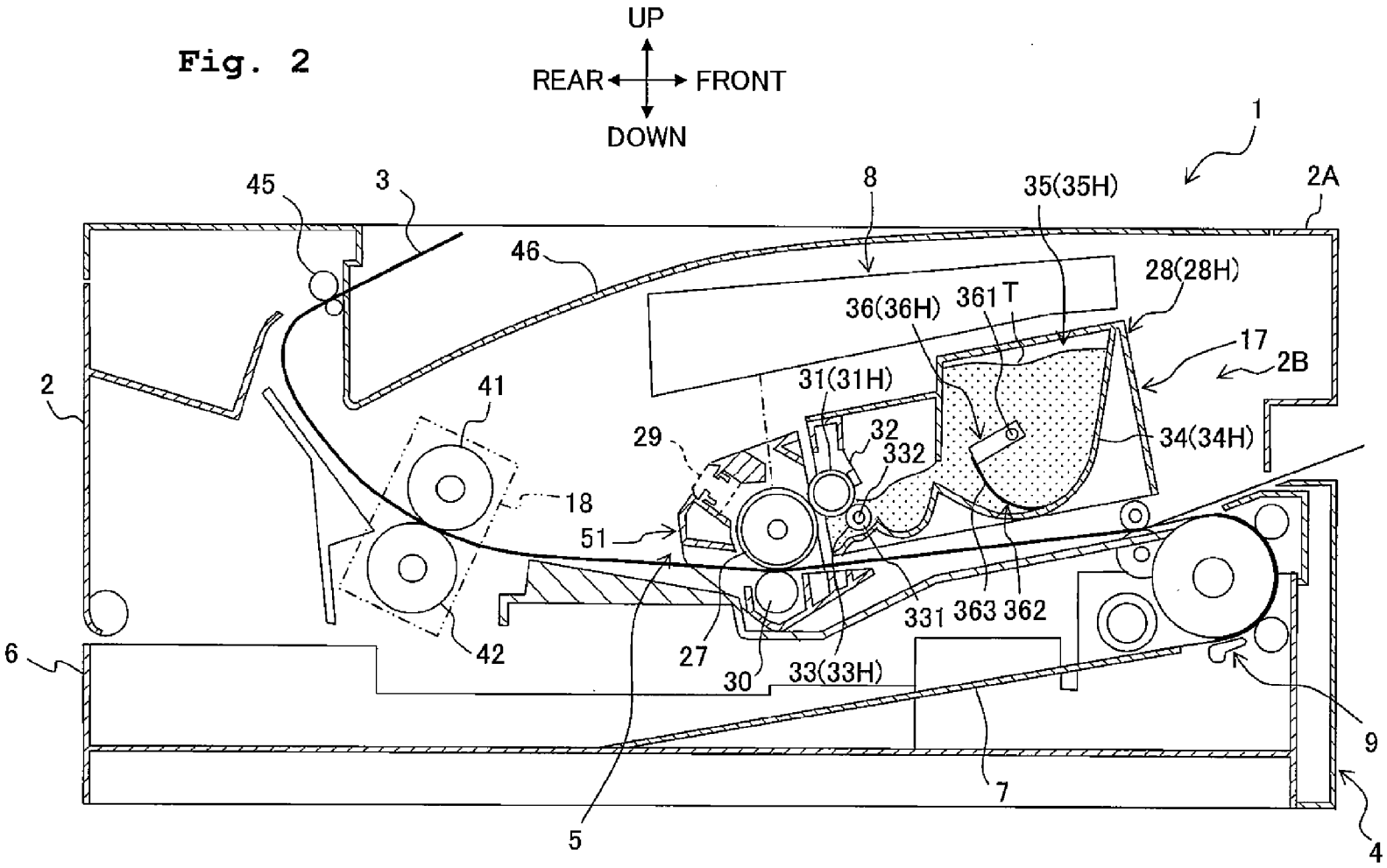
FIG. 2 shows the laser printer in which a large capacity cartridge is installed.

As shown in FIGS. 1 and 2, the image forming system according to the first embodiment is configured such that any one of two types of developing cartridges 28 with toner containers 35 different in capacity is selectively installable in the cartridge installing section 2B of the laser printer 1, that is, in particular, a small capacity cartridge 28L as an example of the first cartridge, and a large capacity cartridge 28H as an example of the second cartridge containing the toner T more than the small capacity cartridge 28L.

In the following explanation, the developing roller 31, the supply roller 33, the case 34, and the agitator 36, which are included in the small capacity cartridge 28L, will also be referred to as first developing roller 31L, first supply roller 33L (an example of the first transport member), first case 34L, and first agitator 36L, respectively. The toner container 35 in the first case 34L will also be referred to as first toner container 35L. Further, the developing roller 31, the supply roller 33, the case 34, and the agitator 36, which are included in the large capacity cartridge 28H, will also be referred to as second developing roller 31H, second supply roller 33H (an example of the second transport member), second case 34H, and second agitator 36H, respectively. The toner container 35 in the second case 34H will also be referred to as second toner container 35H.

Further, in the first embodiment, the small capacity cartridge 28L and the large capacity cartridge 28H are different only in the capacity of the toner container 35 and in the amount of the toner T contained in the toner container 35 when the small capacity cartridge 28L and the large capacity cartridge 28H are unused, but identical in configuration with the other members.

That is, the first developing roller 31L, the first supply roller 33L and the first agitator 36L included in the small capacity cartridge 28L are identical in configuration with the second developing roller 31H, the second supply roller 33H and the second agitator 36H included in the large capacity cartridge 28H, respectively. Further, in order for the second toner container 35H of the large capacity cartridge 28H to be larger in capacity than the first toner container 35L of the small capacity cartridge 28L, such a portion in the second case 34H as to define the second toner container 35H is formed to be larger than such a portion in the first case 34L as to define the first toner container 35L. Further, in a state that the large capacity cartridge 28H and the small capacity cartridge 28L are unused, the second toner container 35H in the second case 34H contains more of the toner T than the first toner container 35L in the first case 34L.

Figure 3:
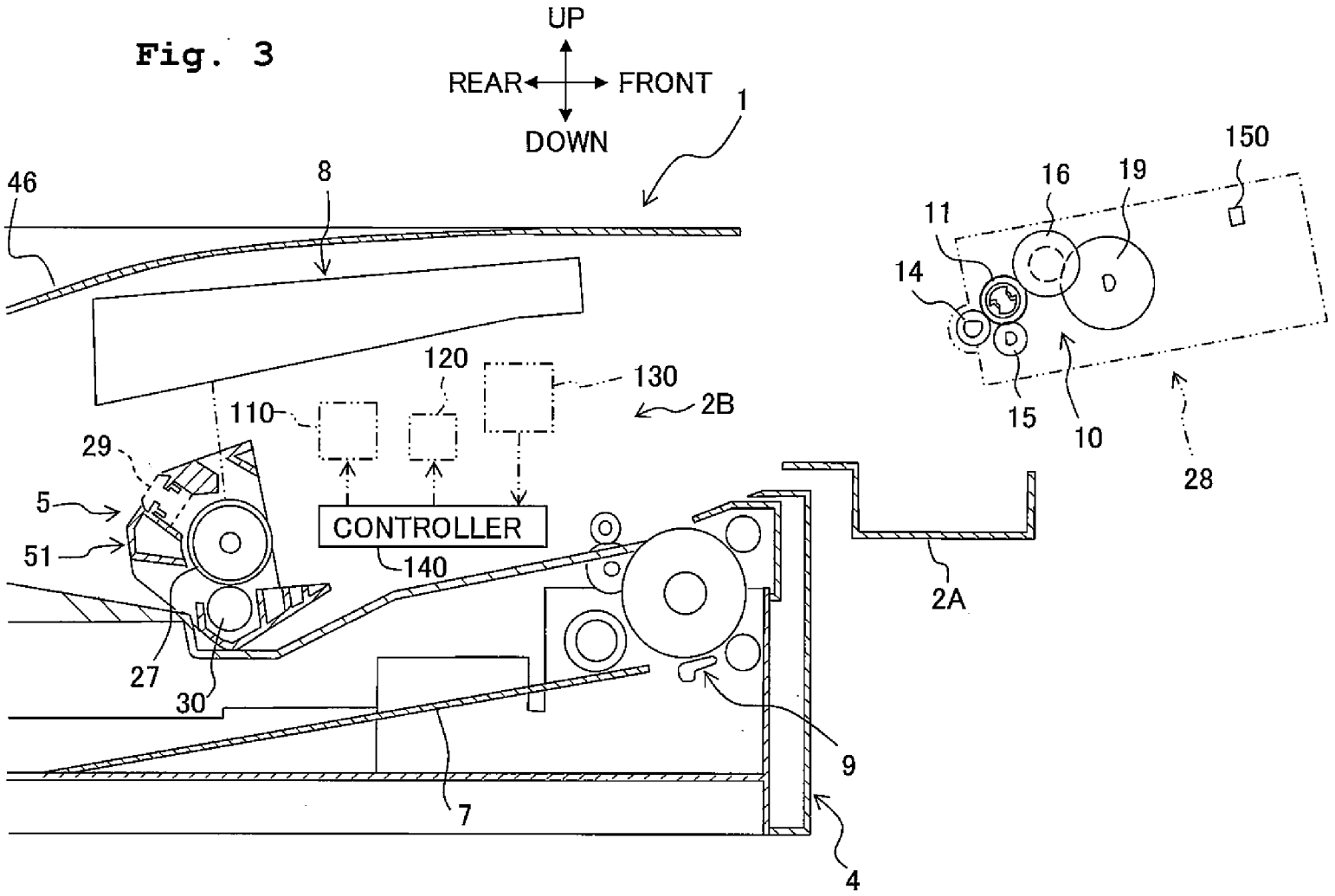
FIG. 3 shows a drive device, a bias application section, a specification detection device, and a controller.
Figure 8:
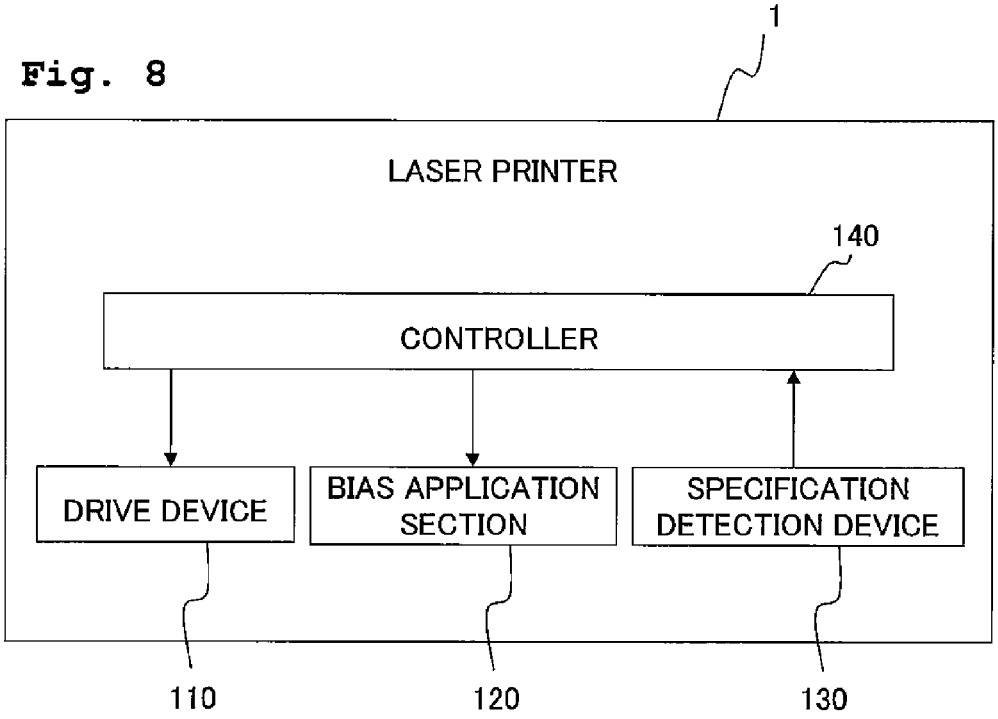
FIG. 8 is a block diagram schematically showing an electrical structure of the printer.

Further, as shown in FIGS. 3 and 8, a drive device 110, a bias application section 120, and a specification detection device 130 are provided in the cartridge installing section 2B of the laser printer 1. Further, a controller 140 is provided inside the apparatus main body 2 of the laser printer 1.

The drive device 110 is constructed from a plurality of gears and a drive motor which are not shown. Further, when the developing cartridge 28 is installed into the cartridge installing section 2B, a gear of the drive device 110 engages with an input gear 11 provided in the developing cartridge 28 such that a drive force is transmitted from the drive motor to the input gear 11 via each of the gears.

Further, the developing cartridge 28 is provided with a gear row 10 which includes the input gear 11 mentioned above, a developing roller gear 14 which rotates integrally with the developing roller 31, a supply roller gear 15 which rotates integrally with the supply roller 33, an intermediate gear 16, and an agitator gear 19 which rotates integrally with the agitator 36. Each of the developing roller gear 14, the supply roller gear 15 and the intermediate gear 16 engages with the input gear 11, while the agitator gear 19 engages with the intermediate gear 16. Further, in the first embodiment, the gear row 10 included in the small capacity cartridge 28L is identical in configuration with the gear row 10 included in the large capacity cartridge 28H.

The bias application section 120 is configured to apply a predetermined bias to the developing roller 31 and the supply roller 33 of the developing cartridge 28 installed in the cartridge installing section 2B, such that the toner T on the supply roller 33 is transported to the developing roller 31.

The specification detection device 130 is a sensor having a publicly known configuration. The specification detection device 130 is configured to detect a detection target portion 150 included in the developing cartridge 28 when the developing cartridge 28 is installed in the cartridge installing section 2B. In particular, the detection target portion 150 has a different configuration between the small capacity cartridge 28L and the large capacity cartridge 28H. Further, the specification detection device 130 is configured to output a different signal to the controller 140 between having detected the detection target portion 150 provided in the small capacity cartridge 28L and having detected the detection target portion 150 provided in the large capacity cartridge 28H.

For example, the detection target portion 150 is configured to move along with the rotation of the gear row 10 when the drive force is inputted to the gear row 10. The detection target portion 150 provided in the small capacity cartridge 28L is different in movement amount from the detection target portion 150 provided in the large capacity cartridge 28H, and the specification detection device 130 is configured to output a signal based on the movement amount of the detection target portion 150.

As shown in FIGS. 3 and 8, the controller 140 is capable of controlling the drive device 110 and the bias application section 120. The controller 140 is configured to determine whether the small capacity cartridge 28L is installed in the cartridge installing section 2B or the large capacity cartridge 28H is installed in the cartridge installing section 2B, based on the signal inputted from the specification detection device 130. The controller 140 is configured to drive the first supply roller 33L to transport the toner T by first transport force in the case of determining that the small capacity cartridge 28L is installed, and to drive the second supply roller 33H to transport the toner T by second transport force smaller than the first transport force in the case of determining that the large capacity cartridge 28H is installed.

In particular, the controller 140 controls the drive device 110 to input the same drive force to the input gear 11 of each of the cartridges 28L and 28H, and to rotate, respectively at the same rotation speed, either the first developing roller 31L, first supply roller 33L and first agitator 36L of the small capacity cartridge 28L or the second developing roller 31H, second supply roller 33H and second agitator 36H of the large capacity cartridge 28H.

Figure 4:
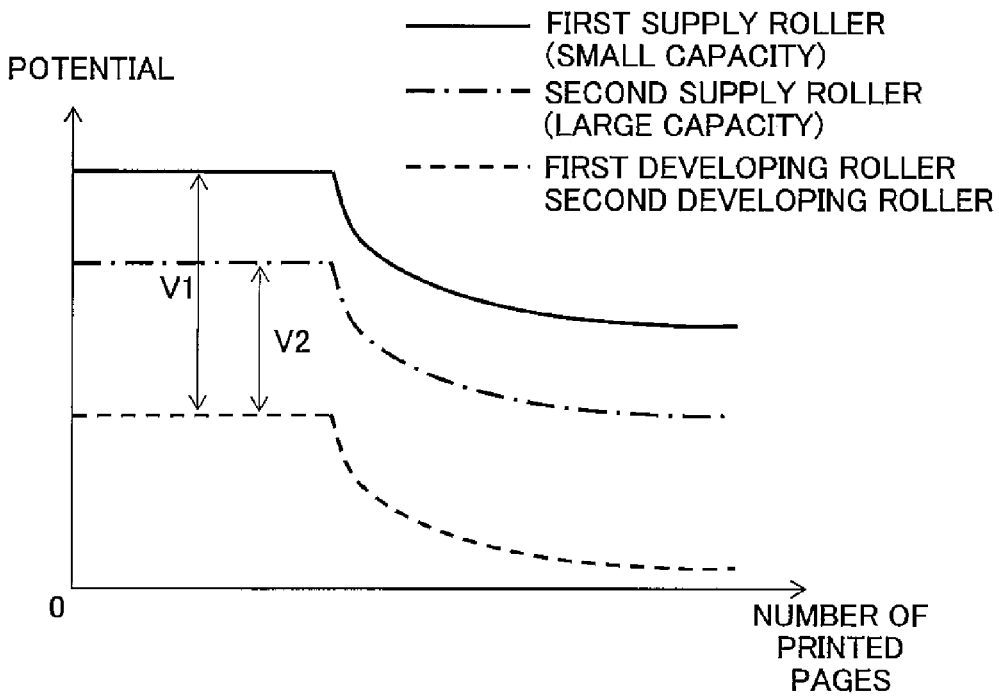
FIG. 4 is a graph for explaining a first bias applied between a first developing roller and a first supply roller, and a second bias applied between a second developing roller and a second supply roller.
Figure 9:
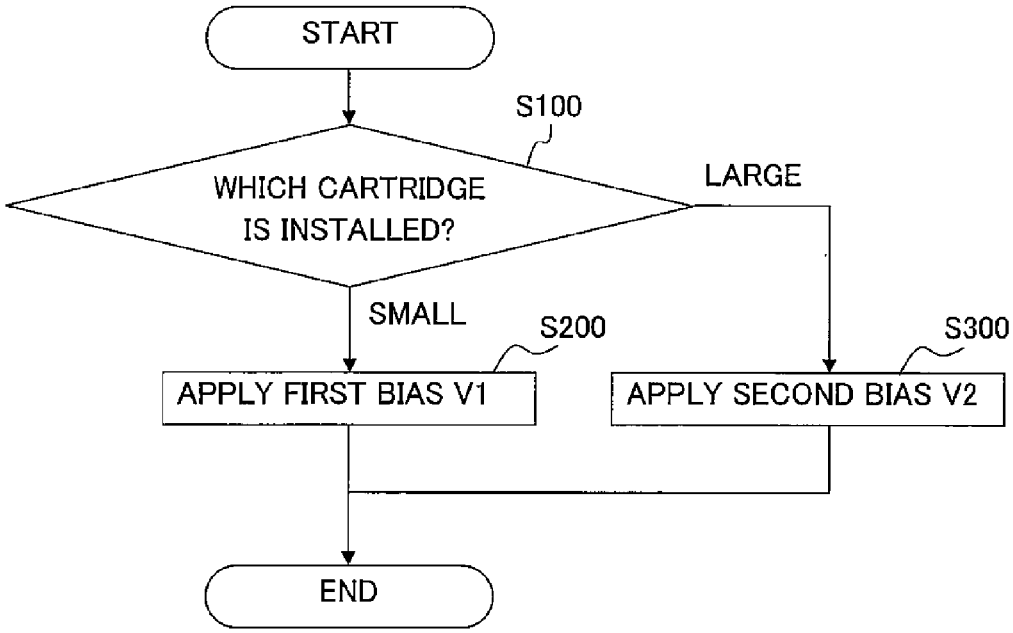
FIG. 9 is a flowchart showing an example of a control process of the controller.

Then, the controller 140 determines whether the small capacity cartridge 28L is installed in the cartridge installing section 2B or the large capacity cartridge 28H is installed in the cartridge installing section 2B, based on the signal inputted from the specification detection device 130. (Step S100 in FIG. 9) In the case of determining that the small capacity cartridge 28L is installed (Step S100: SMALL in FIG. 9), as shown in FIG. 4, the controller 140 is configured to apply a first bias V1 to the first developing roller 31L and the first supply roller 33L by controlling the bias application section 120 to set the first developing roller 31L to a first electric potential and to set the first supply roller 33L to a second electric potential (Step S200 in FIG. 9). Further, if a pulverized toner is used as the toner T, then the toner T may deteriorate when used continuously, thereby causing an increase in a transporting amount of the toner T from the first developing roller 31L to the photosensitive drum 27. Therefore, in the first embodiment, the first electric potential for the first developing roller 31L is set to be constant until the printed pages from the point of installing the pristine small capacity cartridge 28L (with zero printed pages), that is, the accumulated printed pages, exceed a predetermined number, and to decrease gradually after the accumulated printed pages exceed the predetermined number. Further, the second electric potential for the first supply roller 33L is set to be higher than the first electric potential for the first developing roller 31L so that the first bias V1 is constant.

In the case of determining that the large capacity cartridge 28H is installed (Step S100: LARGE in FIG. 9), the controller 140 is configured to apply a second bias V2 to the second developing roller 31H and the second supply roller 33H, by controlling the bias application section 120 to set the second developing roller 31H to a third electric potential and to set the second supply roller 33H to a fourth electric potential (Step S300 in FIG. 9). Further, the third electric potential for the second developing roller 31H is equal to the first electric potential for the first developing roller 31L. Further, the fourth electric potential for the second supply roller 33H is set to be higher than the third electric potential for the second developing roller 31H, so that the second bias V2 is constant.

Further, the magnitude (absolute value) of the second bias V2 is set to be smaller than the magnitude (absolute value) of the first bias V1. That is, in a case that the accumulated printed pages are the same, the fourth potential for the second supply roller 33H is set to be lower than the second potential for the first supply roller 33L.

Now, an explanation will be made on the function and effect of the image forming system configured as described above. If the small capacity cartridge 28L is installed into the cartridge installing section 2B, then the first developing roller 31L and the first supply roller 33L rotate in a state that the first bias V1 is applied to the first developing roller 31L and the first supply roller 33L.

On the other hand, if the large capacity cartridge 28H is installed into the cartridge installing section 2B, then the second developing roller 31H and the second supply roller 33H rotate in a state that the second bias V2, which is smaller than the first bias V1, is applied to the second developing roller 31H and the second supply roller 33H.

On this occasion, because the magnitude of the second bias V2 is smaller than the magnitude of the first bias V1, the toner T which is transported from the second supply roller 33H to the second developing roller 31H is less in amount than the toner T which is transported from the first supply roller 33L to the first developing roller 31L.

That is, in the large capacity cartridge 28H, the second supply roller 33H supplies the second developing roller 31H with less of the toner T. Hence, even though the large capacity cartridge 28H is usable for a longer period of time than the small capacity cartridge 28L, it is still possible to restrain leakage of the toner T.

In the first embodiment described above, the controller 140 is configured to set the second transport force of the second supply roller 33H to be smaller than the first transport force of the first supply roller 33L by changing the bias applied to the developing roller 31 and the supply roller 33, between the case of installing the small capacity cartridge 28L and the case of installing the large capacity cartridge 28H. However, the present teaching is not limited to this configuration. For example, it is also possible to apply a constant bias to the developing roller 31 and the supply roller 33, and to change the rotation speeds of the first supply roller 33L and the second supply roller 33H.

In particular, the drive device 110 may have a first drive motor adapted to drive the input gear 11, and a second drive motor different from the first drive motor. Further, the supply roller gear 15 is configured not to engage with the input gear 11, and the drive force is transmitted thereto from the second drive motor.

In the case of determining that the small capacity cartridge 28L is installed, the controller 140 controls the drive device 110 to drive the first drive motor such that the first developing roller 31L may rotate at a predetermined rotation speed and, meanwhile, to drive the second drive motor such that the first supply roller 33L may rotate at a first rotation speed. On the other hand, in the case of determining that the large capacity cartridge 28H is installed, the controller 140 controls the drive device 110 to drive the first drive motor such that the second developing roller 31H may rotate at the same predetermined rotation speed as that of the first developing roller 31L and, meanwhile, to drive the second drive motor such that the second supply roller 33H may rotate at a second rotation speed slower than the first rotation speed.

On the other hand, the controller 140 is configured to apply the same bias to the developing roller 31 and the supply roller 33, between the case of installing the small capacity cartridge 28L and the case of installing the large capacity cartridge 28H. That is, the first bias V1 and the second bias V2 are set to be the same value.

Being configured as described above, in the large capacity cartridge 28H, the second supply roller 33H rotates slowly against the second developing roller 31H. Therefore, the second supply roller 33H supplies the second developing roller 31H with less of the toner T. By virtue of this, even though the large capacity cartridge 28H is usable for a longer period of time than the small capacity cartridge 28L, it is still possible to restrain leakage of the toner T.

Further, while the rotation speed of the first supply roller 33L (an example of the first transport member) and the rotation speed of the second supply roller 33H (an example of the second transport member) are changed in such a modification as described above, the present teaching is not limited to this method. For example, it is also possible to change the rotation speed of the first agitator 36L (an example of the first transport member) and the rotation speed of the second agitator 36H (an example of the second transport member).

In particular, the gear row 10 may be configured not to have the intermediate gear 16, and thus the drive force is not transmitted from the first drive motor to the agitator gear 19. Instead, the drive force is transmitted from the second drive motor to the agitator gear 19. Further, in such a modification, the supply roller gear 15 engages with the input gear 11.

In the case of determining that the small capacity cartridge 28L is installed, the controller 140 drives the second drive motor such that the first agitator 36L may rotate at a first rotation speed, whereas in the case of determining that the large capacity cartridge 28H is installed, the controller 140 drives the second drive motor such that the second agitator 36H may rotate at a second rotation speed slower than the first rotation speed.

In the case of being configured as described above, in the large capacity cartridge 28H, the second agitator 36H transports less of the toner T toward the second developing roller 31H. Therefore, even though the large capacity cartridge 28H is usable for a longer period of time than the small capacity cartridge 28L, it is still possible to restrain leakage of the toner T.

[Second Embodiment]

Next, a second embodiment of the present teaching will be explained in detail while referring to the accompanying drawings as appropriate. In the second embodiment, the configurations of the small capacity cartridge 28L and the large capacity cartridge 28H are partially changed so as to change the transport force of the first supply roller 33L when the small capacity cartridge 28L is installed and the transport force of the second supply roller 33H when the large capacity cartridge 28H is installed. Further, in the second embodiment, the same reference signs are assigned to the components identical or similar to those in the first embodiment described above, and any explanation therefor will be omitted.

Figure 5A:
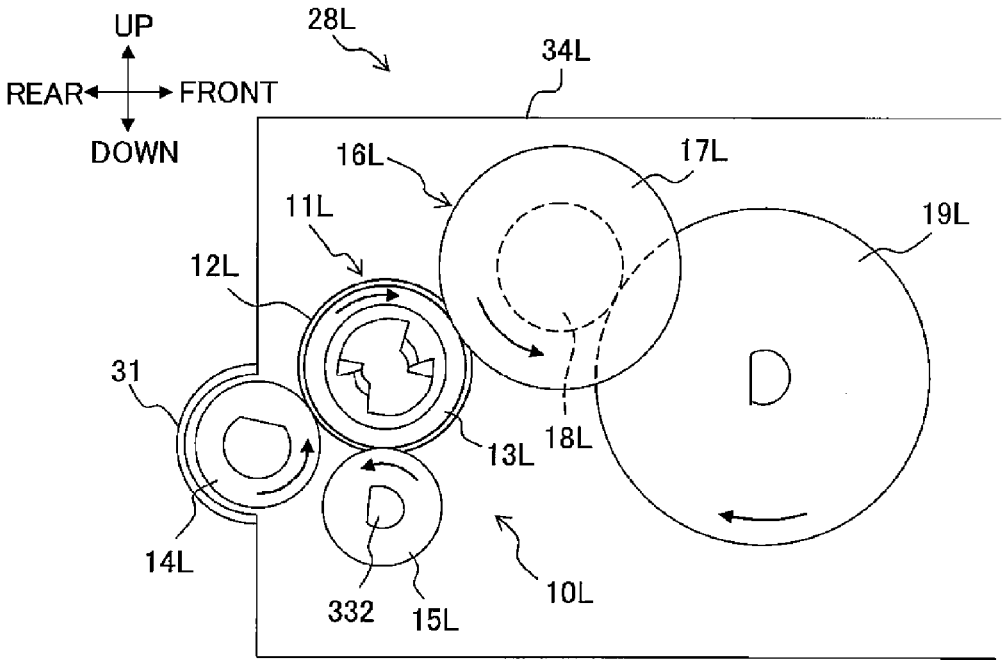
FIG. 5A shows a first gear row of the small capacity cartridge according to a second embodiment of the present teaching.

As shown in FIG. 5A, the small capacity cartridge 28L includes a first gear row 10L on the left lateral side. The first gear row 10L is configured to have a first input gear 11L, a first developing roller gear 14L, a first supply roller gear 15L as an example of the first transport member gear, a first intermediate gear 16L, and a first agitator gear 19L. Further, in FIG. 5A, each gear is shown in the form of a pitch circle.

The first input gear 11L is rotatably supported by the first case 34L, and the drive force from the drive device 110 is inputted thereto if the small capacity cartridge 28L is installed in the cartridge installing section 2B of the laser printer 1. The first input gear 11L has a first large diameter gear portion 12L, and a first small diameter gear portion 13L smaller in diameter than the first large diameter gear portion 12L. Further, the first large diameter gear portion 12L and the first small diameter gear portion 13L are configured to rotate integrally.

The first developing roller gear 14L is fixed on a shaft portion of the first developing roller 31L to rotate integrally with the first developing roller 31L. The first developing roller gear 14L engages with the first large diameter gear portion 12L of the first input gear 11L.

The first supply roller gear 15L is fixed on the supply roller shaft portion 332 of the first supply roller 33L to rotate integrally with the first supply roller 33L. The first supply roller gear 15L engages with the first small diameter gear portion 13L of the first input gear 11L.

The first intermediate gear 16L is rotatably supported by the first case 34L in a position between the first input gear 11L and the first agitator gear 19L. The first intermediate gear 16L has a first large diameter portion 17L, and a first small diameter portion 18L smaller in diameter than the first large diameter portion 17L, where the first large diameter portion 17L and the first small diameter portion 18L are integrally rotatable. Further, the first large diameter portion 17L engages with the first small diameter gear portion 13L of the first input gear 11L.

The first agitator gear 19L is fixed on the shaft portion 361 of the agitator 36 to rotate integrally with the agitator 36. The first agitator gear 19L engages with the first small diameter portion 18L of the first intermediate gear 16L.

Figure 5B:
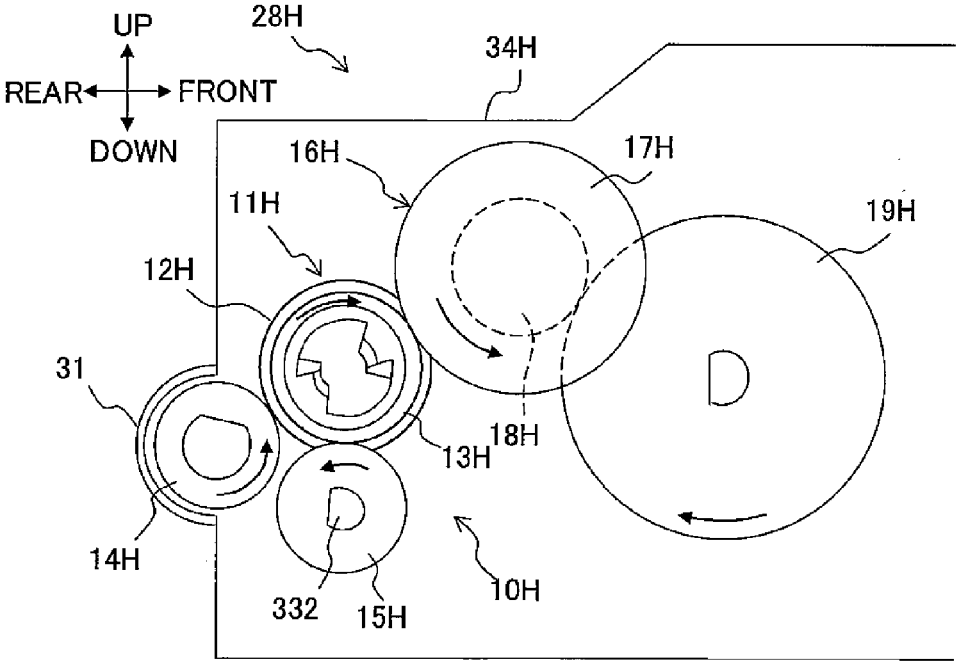
FIG. 5B shows a second gear row of the large capacity cartridge according to the second embodiment.

As shown in FIG. 5B, the large capacity cartridge 28H includes a second gear row 10H on the left lateral side. The second gear row 10H is configured to have a second input gear 11H, a second developing roller gear 14H, a second supply roller gear 15H as an example of the second transport member gear, a second intermediate gear 16H, and a second agitator gear 19H.

In the second gear row 10H, the teeth number of the second input gear 11H and the teeth number of the second developing roller gear 14H are set such that the speed transmission ratio from the second input gear 11H to the second developing roller gear 14H may be equal to the speed transmission ratio from the first input gear 11L to the first developing roller gear 14L. Further, the teeth number of the second input gear 11H and the teeth number of the second supply roller gear 15H are set such that the speed transmission ratio from the second input gear 11H to the second supply roller gear 15H may be larger than the speed transmission ratio from the first input gear 11L to the first supply roller gear 15L. Further, the teeth numbers of the second input gear 11H, the second intermediate gear 16H and the second agitator gear 19H are set such that the speed transmission ratio from the second input gear 11H to the second agitator gear 19H may be equal to the speed transmission ratio from the first input gear 11L to the first agitator gear 19L. Further, since the speed transmission ratio is obtained by dividing the angular speed of the driving-side gear by the angular speed of the driven-side gear, this speed transmission ratio can be expressed in terms of the teeth numbers of the driving-side gear and the driven-side gear, that is, the speed transmission ratio is obtained by dividing the teeth number of the driven-side gear by the teeth number of the driving-side gear.

The second input gear 11H is rotatably supported by the second case 34H, and the drive force from the drive device 110 is inputted thereto if the large capacity cartridge 28H is installed in the cartridge installing section 2B of the laser printer 1. The second input gear 11H has a second large diameter gear portion 12H, and a second small diameter gear portion 13H smaller in diameter than the second large diameter gear portion 12H. Further, the second large diameter gear portion 12H and the second small diameter gear portion 13H are configured to rotate integrally.

The second large diameter gear portion 12H has the same configuration and the same teeth number as the first large diameter gear portion 12L of the first input gear 11L included in the small capacity cartridge 28L.

The second developing roller gear 14H is fixed on a shaft portion of the second developing roller 31H to rotate integrally with the second developing roller 31H. The second developing roller gear 14H engages with the second large diameter gear portion 12H of the second input gear 11H. The second developing roller gear 14H has the same configuration and the same teeth number as the first developing roller gear 14L.

The second supply roller gear 15H is fixed on the supply roller shaft portion 332 of the second supply roller 33H to rotate integrally with the second supply roller 33H. The second supply roller gear 15H engages with the second small diameter gear portion 13H of the second input gear 11H. Further, the second supply roller gear 15H has a larger teeth number than the first supply roller gear 15L.

Further, the second small diameter gear portion 13H of the second input gear 11H engaging with the second supply roller gear 15H has a smaller teeth number than the first small diameter gear portion 13L.

The second intermediate gear 16H is rotatably supported by the second case 34H in a position between the second input gear 11H and the second agitator gear 19H. The second intermediate gear 16H has a second large diameter portion 17H, and a second small diameter portion 18H smaller in diameter than the second large diameter portion 17H, where the second large diameter portion 17H and the second small diameter portion 18H are integrally rotatable. Further, the second large diameter portion 17H engages with the second small diameter gear portion 13H of the second input gear 11H.

With respect to the second intermediate gear 16H, the second large diameter portion 17H has a larger teeth number than the first large diameter portion 17L of the first intermediate gear 16L, while the second small diameter portion 18H has a larger teeth number than the first small diameter portion 18L of the first intermediate gear 16L.

The second agitator gear 19H is fixed on the shaft portion 361 of the agitator 36 to rotate integrally with the agitator 36. The second agitator gear 19H engages with the second small diameter portion 18H of the second intermediate gear 16H. Further, the second agitator gear 19H has a smaller teeth number than the first agitator gear 19L.

Further, in the second embodiment, the controller 140 controls the bias application section 120 to apply the same bias to the developing roller 31 and the supply roller 33, in the case of installing the small capacity cartridge 28L and in the case of installing the large capacity cartridge 28H. That is, the first bias V1 and the second bias V2 are set to be the same value. Further, the controller 140 controls the drive device 110 to input the same drive force to the first input gear 11L and the second input gear 11H, in the case of installing the small capacity cartridge 28L and in the case of installing the large capacity cartridge 28H.

In the image forming system configured as described above, if the small capacity cartridge 28L is installed in the cartridge installing section 2B, then the drive force is inputted to the first input gear 11L to start rotating the respective gears constituting the first gear row 10L. This leads to the rotations of the first developing roller 31L, first supply roller 33L and agitator 36 of the small capacity cartridge 28L.

Further, if the large capacity cartridge 28H is installed in the cartridge installing section 2B, then the drive force is inputted to the second input gear 11H to start rotating the respective gears constituting the second gear row 10H. This leads to the rotations of the second developing roller 31H, second supply roller 33H and agitator 36 of the large capacity cartridge 28H.

On this occasion, because the speed transmission ratio from the second input gear 11H to the second supply roller gear 15H is larger than the speed transmission ratio from the first input gear 11L to the first supply roller gear 15L included in the small capacity cartridge 28L, the rotation speed of the second supply roller gear 15H is slower than the rotation speed of the first supply roller gear 15L. That is, the second supply roller 33H of the large capacity cartridge 28H has a slower circumferential speed than the first supply roller 33L of the small capacity cartridge 28L.

On the other hand, because the speed transmission ratio from the second input gear 11H to the second developing roller gear 14H is equal to the speed transmission ratio from the first input gear 11L to the first developing roller gear 14L, the rotation speed of the second developing roller gear 14H is equal to the rotation speed of the first developing roller gear 14L. That is, the second developing roller 31H of the large capacity cartridge 28H has the same circumferential speed as the first developing roller 31L of the small capacity cartridge 28L.

Therefore, in the large capacity cartridge 28H, the second supply roller 33H rotates slowly against the second developing roller 31H as compared with the small capacity cartridge 28L, and thus the second transport force for the second supply roller 33H to transport the toner T is smaller than the first transport force for the first supply roller 33L to transport the toner T.

On this occasion, in the large capacity cartridge 28H, the second supply roller 33H supplies the second developing roller 31H with less of the toner T. Therefore, even though the large capacity cartridge 28H is usable for a longer period of time than the small capacity cartridge 28L, it is still possible to restrain leakage of the toner T.

Figure 6A:
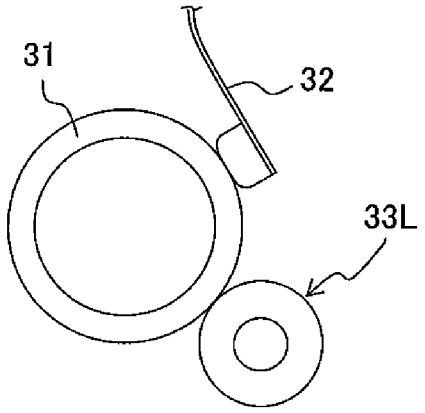
FIG. 6A shows the first supply roller according to a modification.
Figure 6B:
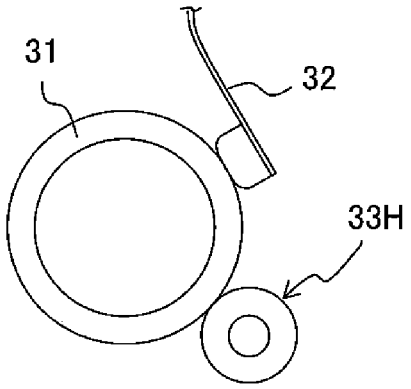
FIG. 6B shows the second supply roller according to the modification.

In the second embodiment described above, by letting the speed transmission ratio from the second input gear 11H to the second supply roller gear 15H be larger than the speed transmission ratio from the first input gear 11L to the first supply roller gear 15L, the circumferential speed of the second supply roller 33H is caused to be slower than the circumferential speed of the first supply roller 33L. However, the configuration for causing the circumferential speed of the second supply roller 33H to be slower than the circumferential speed of the first supply roller 33L is not limited to this. For example, as shown in FIGS. 6A and 6B, the circumferential speed of the second supply roller 33H may also be caused to be slower than the circumferential speed of the first supply roller 33L by changing the diameters of the first supply roller 33L and the second supply roller 33H.

In particular, the second supply roller 33H included in the large capacity cartridge 28H has a smaller diameter than the first supply roller 33L included in the small capacity cartridge 28L.

Further, in such a modification, the second input gear 11H (the second small diameter gear portion 13H) and the second supply roller gear 15H are configured such that the speed transmission ratio from the second input gear 11H to the second supply roller gear 15H may be equal to the speed transmission ratio from the first input gear 11L to the first supply roller gear 15L. Accordingly, the first supply roller gear 15L in the first gear row 10L rotates at the same angular speed as the second supply roller gear 15H in the second gear row 10H.

Being configured as described above, although the first supply roller 33L rotates at the same angular speed as the second supply roller 33H, due to the different diameters, the second supply roller 33H has a slower circumferential speed than the first supply roller 33L. By virtue of this, the transport force for the second supply roller 33H to transport the toner T to the second developing roller 31H becomes smaller than the transport force for the first supply roller 33L to transport the toner T to the first developing roller 31L.

Further, in order to cause the transport force for the second supply roller 33H to transport the toner T to be smaller than the transport force for the first supply roller 33L to transport the toner T, the supply roller body 331 of the second supply roller 33H may be configured to have a higher electrical resistance than the supply roller body 331 of the first supply roller 33L. For example, if the supply roller body 331 is made of urethane foam impregnated with a carbon solvent, then it is possible to change the electrical resistance by changing the amount of the carbon solvent impregnating the urethane foam, between the first supply roller 33L and the second supply roller 33H. Further, it is also possible to place a resistor between the second supply roller 33H, and any electrode supplying electricity to the first supply roller 33L or the second supply roller 33H.

Further, if the first supply roller 33L and the second supply roller 33H are configured as described above, then the controller 140 controls the bias application section 120 to apply the same electric current to the first supply roller 33L and to the second supply roller 33H and, meanwhile, to set the first developing roller 31L and the second developing roller 31H at the same electric potential, in the case of installing the small capacity cartridge 28L and in the case of installing the large capacity cartridge 28H.

Being configured as described above, because the second supply roller 33H has a lower electric potential than the first supply roller 33L, the electric potential difference between the second developing roller 31H and the second supply roller 33H (the second bias V2) is smaller than the electric potential difference between the first developing roller 31L and the first supply roller 33L (the first bias V1). By virtue of this, the transport force for the second supply roller 33H to transport the toner T is smaller than the transport force for the first supply roller 33L to transport the toner T.

In the second embodiment described above, the transport force for the second supply roller 33H (an example of the second transport member) to transport the toner T is smaller than the transport force for the first supply roller 33L (an example of the first transport member) to transport the toner T. However, the present teaching is not limited to this but, for example, the transport force for the second agitator 36H (an example of the second transport member) included in the large capacity cartridge 28H to transport the toner T may be smaller than the transport force for the first agitator 36L (an example of the first transport member) included in the small capacity cartridge 28L to transport the toner T.

In particular, the teeth numbers of the second input gear 11H (the second small diameter gear portion 13H), the second intermediate gear 16H and the second agitator gear 19H are set such that the speed transmission ratio from the second input gear 11H to the second agitator gear 19H (an example of the second transport member gear) may be larger than the speed transmission ratio from the first input gear 11L to the first agitator gear 19L (an example of the first transport member gear).

Being configured as described above, the rotation speed of the second agitator 36H when the large capacity cartridge 28H is installed becomes slower than the rotation speed of the first agitator 36L when the small capacity cartridge 28L is installed. That is, the first agitator 36L transports the toner T in the first case 34L to the first developing roller 31L by the first transport force, while the second agitator 36H transports the toner T in the second case 34H to the second developing roller 31H by the second transport force smaller than the first transport force. On this occasion, in the large capacity cartridge 28H, the second agitator 36H transports less of the toner T toward the second developing roller 31H. Therefore, even though the large capacity cartridge 28H is usable for a longer period of time than the small capacity cartridge 28L, it is still possible to restrain leakage of the toner T.

Figure 7A:
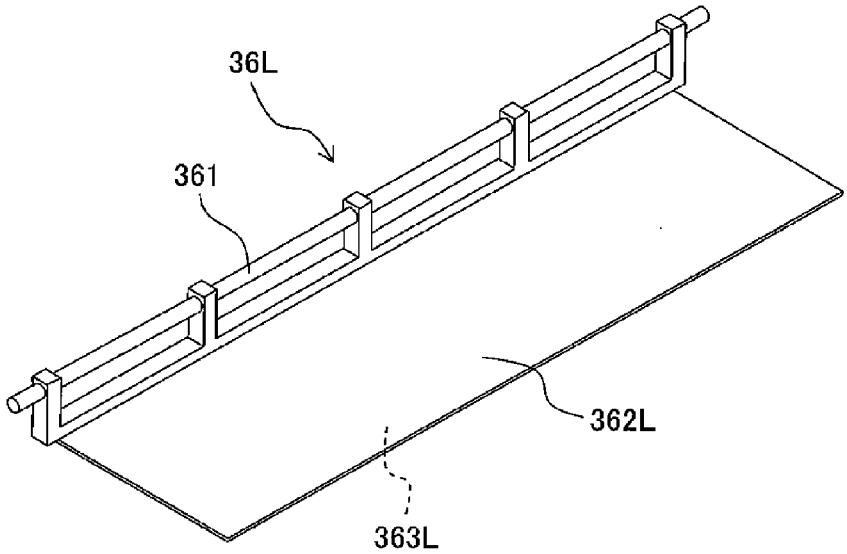
FIG. 7A is a perspective view showing a first agitator according to another modification.
Figure 7B:
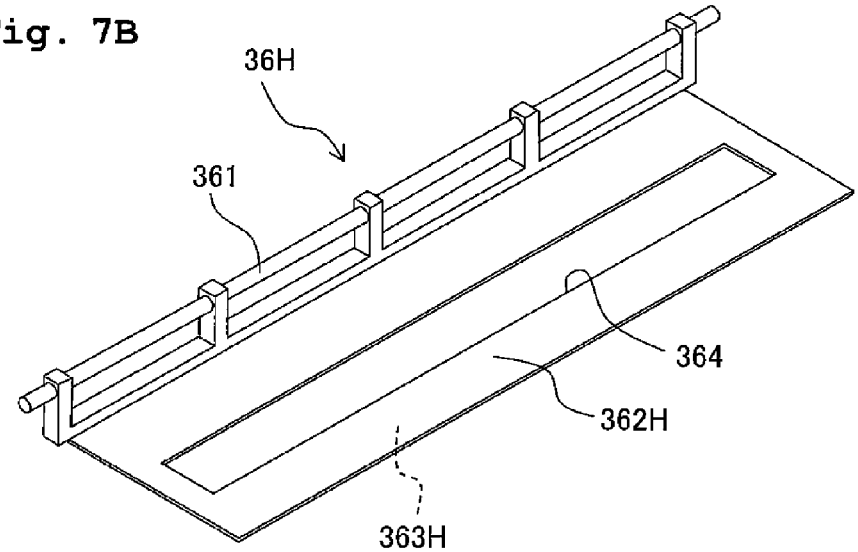
FIG. 7B is a perspective view showing a second agitator according to the another modification.

Further, in order to make the transport force for the second agitator 36H included in the large capacity cartridge 28H to transport the toner T be smaller than the transport force for the first agitator 36L included in the small capacity cartridge 28L to transport the toner T, as shown in FIGS. 7A and 7B for example, the first agitator 36L and the second agitator 36H may have different configurations.

In particular, as shown in FIG. 7B, the second agitator 36H has an opening portion 364, in a second agitating blade 362H fixed on the aforementioned shaft portion 361 (an example of the second rotating shaft), which extends from one end to the other end along the extending direction of the shaft portion 361.

On the other hand, as shown in FIG. 7A, the first agitator 36L does not have such an opening portion, as that in the second agitating blade 362H, in a first agitating blade 362L fixed on the aforementioned shaft portion 361 (an example of the first rotating shaft).

By configuring the first agitating blade 362L and the second agitating blade 362H as described above, as shown in FIGS. 7A and 7B, a transport surface 363H (an example of the second transport surface) of the second agitating blade 362H has a smaller area than a transport surface 363L (an example of the first transport surface) of the first agitating blade 362L. By virtue of this, the second transport force for the second agitator 36H to transport the toner T becomes smaller than the first transport force for the first agitator 36L to transport the toner T.

Further, the second agitating blade 362H may be formed not to have the only one opening portion 364 as in the modification described above, but to have a plurality of small opening portions 364 along the extending direction of the shaft portion 361.

While some embodiments of the present teaching are explained above, the present teaching is not limited to the embodiments described above. It is possible to change and modify any specific configuration as appropriate without departing from the true spirit and scope of the present teaching. Further, in the following explanation, the same reference signs are assigned to the components identical or similar to those in the embodiments described above, and any explanation therefor will be omitted.

While the second case 34H is larger than the first case 34L in the above embodiments, the present teaching is not limited to this configuration. For example, provided that the second case 34H is as large as the first case 34L, by changing the amounts of the toner T to be contained in the first case 34L and the second case 34H, the second case 34H may contain a larger amount of the toner T than the first case 34L in a state that the small capacity cartridge 28L and the large capacity cartridge 28H are unused.

While the developer is a positively charged toner T in the above embodiments, the present teaching is not limited to this application, but may adopt a negatively charged toner T as the developer. In such a case, the controller 140 is configured to control the bias application section 120 to apply such a bias to the developing roller 31 and the supply roller 33 as to transport the toner T on the supply roller 33 to the developing roller 31 by setting the supply roller 33 at a lower electric potential than the developing roller 31.

In the first embodiment, the small capacity cartridge 28L and the large capacity cartridge 28H are different only in the capacity of the toner container 35 and in the amount of the toner T contained in the toner container 35 in the state that the small capacity cartridge 28L and the large capacity cartridge 28H are unused, but identical in configuration with the other corresponding members (the developing roller 31, the supply roller 33, etc.). However, those other corresponding members may also differ in configuration. In such cases, the rotation speed of the drive motor controlled by the controller 140, as well as the first bias V1 and the second bias V2, is set such that the second transport force of the second supply roller 33H may be smaller than the first transport force of the first supply roller 33L.

In the above embodiments, the developing cartridge 28 is exemplified as the first cartridge and the second cartridge in two types different in capacity for the toner T. However, the present teaching is not limited to this exemplification. For example, the first cartridge and the second cartridge may be two types of process cartridges which differ in capacity for the toner T and integrate the developing cartridge 28 and the drum unit 51 of the above embodiments.

In the above embodiments, the black-and-white laser printer 1 is exemplified as the image forming apparatus capable of installing only one developing cartridge 28. However, the present teaching is not limited to this exemplification. For example, the present teaching may also be applied to color printers capable of installing a plurality of developing cartridges 28.

What is claimed is:

1. An image forming apparatus comprising:

a cartridge installing section in which a first cartridge and a second cartridge are selectively installable, the first cartridge comprising: a first case configured to contain a first developer; a first developing roller; and a first transport member configured to transport the first developer toward the first developing roller, and the second cartridge comprising: a second case configured to contain a second developer, an amount of the second developer being greater than an amount of the first developer; a second developing roller; and a second transport member configured to transport the second developer toward the second developing roller; and a controller configured to:

determine whether the first cartridge is installed in the cartridge installing section or the second cartridge is installed in the cartridge installing section;

control a drive source to drive the first transport member to transport the first developer by a first transport force, in a case that the controller determines that the first cartridge is installed in the cartridge installing section; and control the drive source to drive the second transport member to transport the second developer by a second transport force which is smaller than the first transport force, in a case that the controller determines that the second cartridge is installed in the cartridge installing section, wherein the first transport member is a first supply roller configured to supply the first developer to the first developing roller, and wherein the second transport member is a second supply roller configured to supply the second developer to the second developing roller.

2. The image forming apparatus according to claim 1, wherein the first supply roller and the second supply roller are configured to rotate, and the controller is further configured to:

control the drive source to drive the first supply roller at a first rotation speed, in the case that the controller determines that the first cartridge is installed in the cartridge installing section; and control the drive source to drive the second supply roller at a second rotation speed slower than the first rotation speed, in the case that the controller determines that the second cartridge is installed in the cartridge installing section.

3. The image forming apparatus according to claim 1, wherein the first supply roller faces the first developing roller, the second supply roller faces the second developing roller, and the controller is further configured to:

apply a first bias to the first developing roller and the first supply roller to transport the first developer on the first supply roller to the first developing roller, in the case that the controller determines that the first cartridge is installed in the cartridge installing section; and apply a second bias, which is smaller than the first bias, to the second developing roller and the second supply roller to transport the second developer on the second supply roller to the second developing roller, in the case that the controller determines that the second cartridge is installed in the cartridge installing section.

4. An image forming system comprising:

a first cartridge comprising:

a first case configured to contain a first developer;

a first developing roller; and a first transport member configured to transport the first developer in the first case toward the first developing roller by first transport force;

a second cartridge comprising:

a second case configured to contain a second developer, an amount of the second developer being greater than an amount of the first developer in the first case;

a second developing roller; and a second transport member configured to transport the second developer in the second case toward the second developing roller by second transport force which is smaller than the first transport force; and an image forming apparatus comprising a cartridge installing section in which the first cartridge and the second cartridge are selectively installable, wherein the first transport member is a first supply roller configured to supply the first developer to the first developing roller, and the second transport member is a second supply roller configured to supply the second developer to the second developing roller.

5. The image forming system according to claim 4, wherein the second supply roller has a diameter which is smaller than that of the first supply roller.

6. The image forming system according to claim 4, wherein the second supply roller has an electrical resistance which is higher than that of the first supply roller.

7. The image forming system according to claim 4, wherein the first cartridge comprises:

a first developing roller gear configured to rotate integrally with the first developing roller;

a first supply roller gear configured to rotate integrally with the first supply roller; and a first input gear configured to transmit a drive force inputted from a drive source to the first developing roller gear and the first supply roller gear, in a case that the first cartridge is installed in the cartridge installing section, the second cartridge comprises:

a second developing roller gear configured to rotate integrally with the second developing roller;

a second supply roller gear configured to rotate integrally with the second supply roller; and a second input gear configured to transmit the drive force inputted from the drive source to the second developing roller gear and the second supply roller gear, in a case that the second cartridge is installed in the cartridge installing section, a speed transmission ratio from the first input gear to the first developing roller gear is same as a speed transmission ratio from the second input gear to the second developing roller gear, and a speed transmission ratio from the second input gear to the second supply roller gear is greater than a speed transmission ratio from the first input gear to the first supply roller gear.

8. The image forming system according to claim 4, wherein the first cartridge comprises:

a first developing roller gear configured to rotate integrally with the first developing roller;

a first supply roller gear configured to rotate integrally with the first supply roller; and a first input gear configured to transmit a drive force inputted from a drive source to the first developing roller gear and the first supply roller gear, in a case that the first cartridge is installed in the cartridge installing section, the second cartridge comprises:

a second developing roller gear configured to rotate integrally with the second developing roller;

a second supply roller gear configured to rotate integrally with the second supply roller; and a second input gear configured to transmit the drive force inputted from the drive source to the second developing roller gear and the second supply roller gear, in a case that the second cartridge is installed in the cartridge installing section, the second supply roller gear has a larger number of teeth than the first supply roller gear, and the second input gear has a smaller number of teeth that the first input gear.

9. An image forming system comprising:

a first cartridge comprising;

a first case configured to contain a first developer;

a first developing roller; and a first agitator comprising a first rotating shaft and a first agitating blade provided on the first rotating shaft and having a first transport surface configured to transport the first developer by a first transport force;

a second cartridge comprising:

a second case configured to contain a second developer, an amount of the second developer being greater than an amount of the first developer in the first case;

a second developing roller; and a second agitator comprising a second rotating shaft and a second agitating blade provided on the second rotating shaft and having a second transport surface configured to transport the second developer by a second transport force which is smaller than the first transport force; and an image forming apparatus comprising a cartridge installing section in which the first cartridge and the second cartridge are selectively installable, wherein an area of the second transport surface is smaller than an area of the first transport surface.

10. The image forming system according to claim 9, wherein the second agitator has an opening formed in the second transport surface, and the first agitator does not have an opening formed in the first transport surface.

* * * * *